US008578569B1

(12) United States Patent
Karnoski et al.

(10) Patent No.: US 8,578,569 B1
(45) Date of Patent: Nov. 12, 2013

(54) COUPLERS

(75) Inventors: Stephen Ray Karnoski, Camarillo, CA (US); Dennis Michael How, Camarillo, CA (US); James F. Jenkins, Cambria, CA (US)

(73) Assignee: United States of America as Represented by the Secretary of the Navy, Washington, DC (US)

( * ) Notice: Subject to any disclaimer, the term of this patent is extended or adjusted under 35 U.S.C. 154(b) by 163 days.

(21) Appl. No.: 13/204,906

(22) Filed: Aug. 8, 2011

(51) Int. Cl.
*B63B 22/14* (2006.01)

(52) U.S. Cl.
USPC ..... 24/303; 24/602; 441/10

(58) Field of Classification Search
USPC ..... 24/572.1, 303, 115 F, 602, 603; 248/205.5, 205.7, 206.1, 206.2; 403/32; 294/189; 279/3; 441/7, 10
See application file for complete search history.

(56) References Cited

U.S. PATENT DOCUMENTS

| | | | | | |
|---|---|---|---|---|---|
| 1,766,828 | A * | 6/1930 | Mulroney | 24/578.1 |
| 2,730,370 | A * | 1/1956 | Brewster | 264/571 |
| 3,041,697 | A * | 7/1962 | Budreck | 24/303 |
| 3,111,736 | A * | 11/1963 | Budreck | 24/303 |
| 4,231,137 | A * | 11/1980 | Fujimoto | 24/303 |
| 4,543,695 | A * | 10/1985 | Dorsey | 24/662 |
| 4,571,788 | A * | 2/1986 | Bruengger | 24/602 |
| 4,763,941 | A * | 8/1988 | Sniderman | 294/186 |
| 6,554,241 | B1 * | 4/2003 | Leshem | 248/362 |
| 7,631,912 | B2 * | 12/2009 | Hupp | 294/189 |

* cited by examiner

*Primary Examiner* — James Brittain
(74) *Attorney, Agent, or Firm* — Christopher L. Blackburn

(57) ABSTRACT

A mechanical coupler that separates at a pre-determined ambient pressure.

10 Claims, 2 Drawing Sheets

COUPLERS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

Embodiments of the invention generally relate to a mechanical coupler(s).

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF THE EMBODIMENTS OF THE INVENTION

Embodiments of the invention generally relate to a mechanical connect/disconnect coupler.

With reference to FIGS. 1-5, embodiments of the invention include a first member 2 and a second member 4.

Figure 1:
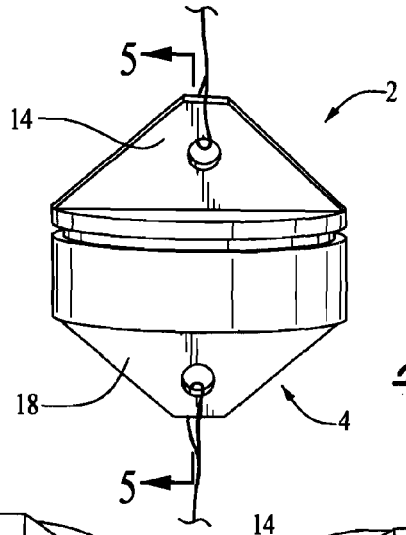
FIG. 1 is perspective view of an assembled embodiment of the invention.
Figure 2:
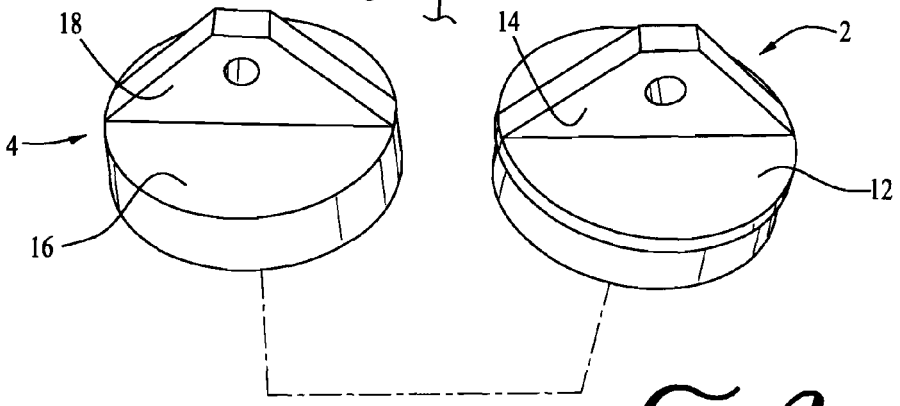
FIG. 2 is a perspective view of an unassembled embodiment of the invention.
Figure 3:
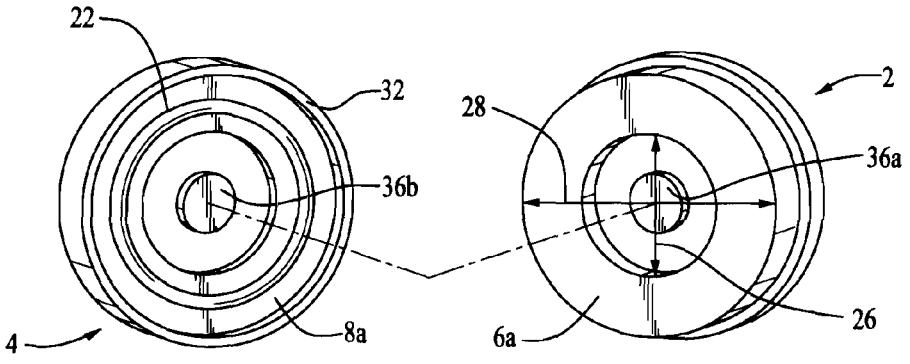
FIG. 3 is a perspective view of an unassembled embodiment of the invention.
Figure 4:
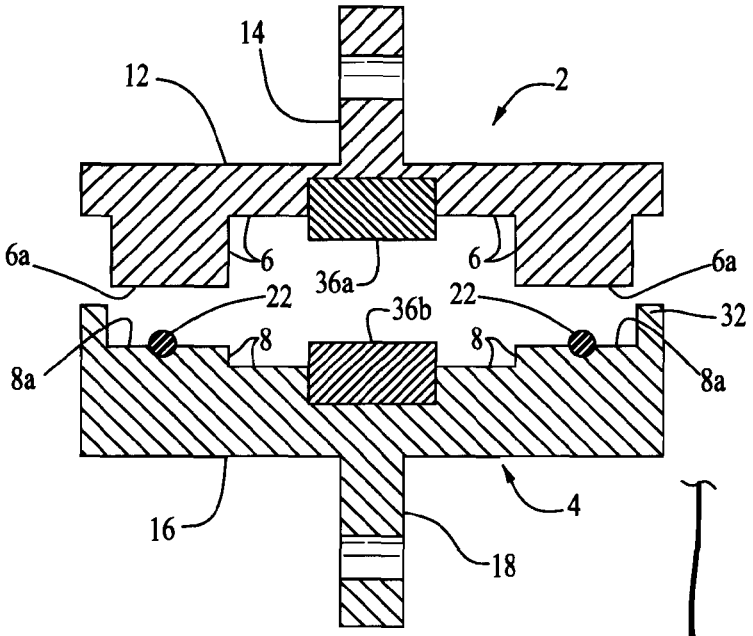
FIG. 4 is a vertical sectional view of an unassembled embodiment of the invention.
Figure 5:
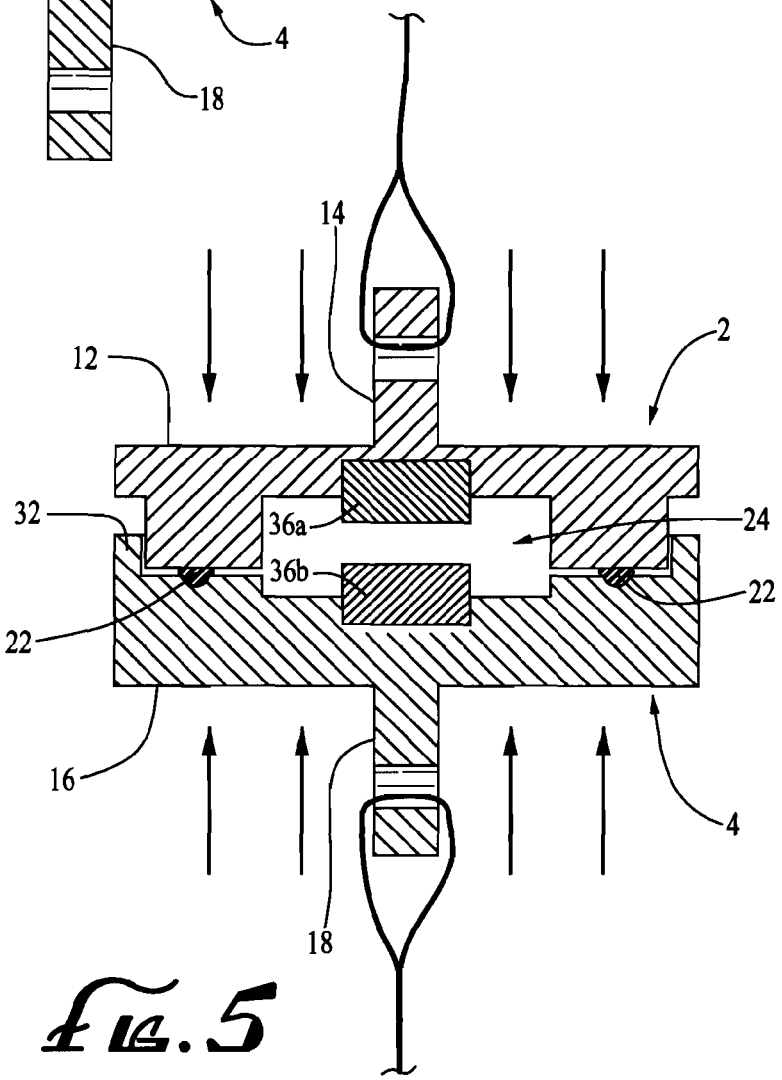
FIG. 5 is a vertical sectional view of an assembled embodiment of the invention.

With reference to FIGS. 3-5, the first member 2 includes a first member bottom surface (6, 6*a*). The first member bottom surface (6, 6*a*) includes a first member coupling surface 6*a*. With reference to FIGS. 2, 4, and 5, the first member 2 includes a first member upper surface 12. A float attachment 14 is associated with (or extends from) the first member upper surface 12. The float attachment 14 is a structural feature (capable of serving as a connector) to connect a float to the first member upper surface 12. In some embodiments, the float attachment 14 is a tab like protrusion (associated with, or protruding from, the first member upper surface) that includes a hole through which a line associated with a float can be passed. With reference to FIGS. 4 and 5, the first member bottom surface (6, 6*a*) is formed of a first member depressed section 6 within the inner edge of the first member coupling surface 6*a*, with the depressed section 6 being depressed relative to the first member coupling surface 6*a*.

With reference to FIGS. 3-5, the second member 4 includes a second member bottom surface (8, 8*a*). The second member bottom surface (8, 8*a*) includes a second member coupling surface 8*a*. With reference to FIGS. 2, 4, and 5, the second member includes a second member upper surface 16. A weight attachment 18 is associated with the second member upper surface 16. The weight attachment 14 is a structural feature (capable of serving as a connector) to connect a weight to the first member upper surface 12. In some embodiments, the weight attachment is a tab like protrusion (associated with, or protruding from, the second member upper surface) that includes a hole through which a line associated with a weight can be passed. With reference to FIGS. 4 and 5, the second member bottom surface (8, 8*a*) includes a second member depressed portion 8 within the inner edge of the second member coupling surface 8*a*, with the second member depressed portion 8 being depressed relative to the second member coupling surface 8*a*. In some embodiments, the second member 4 includes a protruding portion 32 that protrudes downward (where downward is the direction from the upper surface to the bottom surface) from the second member coupling surface 8*a*. The protruding portion 32 is dimensioned such that the outer edge of the first member coupling surface 6*a* fits within the area defined by the inner edge of the protruding portion 32, and such that, when assembled, the protruding portion 32 prevents radial movement of the first member 2 and second member 4 an amount equal to or greater than the least radial displacement distance that would in and of itself result in the sealed cavity 24 becoming unsealed.

With reference to FIGS. 3-5, at least one seal 22 is associated with a groove within one of the first member coupling surface 6*a* and the second member coupling surface 8*a*. The seal 22 can be any known type of mechanical gasket. In some embodiments, the seal 22 is an o-ring seal (a loop of elastomer with a disc-shaped cross-section, dimensioned to be seated in a groove and compressed during assembly between two or more parts, creating a seal at the interface). With reference to FIG. 5, when assembled, the first member coupling surface 6*a* and the second member coupling surface 8*a* both sealingly interface with at least one seal 22; as exemplarily illustrated in FIG. 5, when sealingly interfaced, the mechanical gasket 22 in some embodiments is deformed as a result of compression. A cavity 24 is formed within the volume defined by the first member 2, second member 4, and seal 22 when the first member 2 and the second member 4 are sealingly interfaced with the at least one seal 22. The quantity of three-dimensional space of the cavity 24 is defined by the three-dimensional empty space within the volume enclosed by a boundary formed of the first member bottom surface (6, 6*a*), the second member bottom surface (8, 8*a*), and the seal 22 (in some embodiments, within a vertically displaced plane formed by the seal 22). In some embodiments, the dimensions of the cavity 24 are influenced by a magnet(s) 36*a, b*.

In some embodiments, the first member coupling surface (6, 6*a*) is annular and has a first member coupling surface predetermined inner diameter and a first member coupling surface predetermined outer diameter. In these embodiments, the second member coupling surface (8, 8*a*) is annular and has a second member coupling surface predetermined inner diameter and a second member coupling surface predetermined outer diameter. In these embodiments, the seal 22 is also annular. In these embodiments, the width and radius of the first member annular coupling surface (6, 6*a*) and the width and radius of the second member annular coupling surface (8, 8*a*) are dimensioned such that, when assembled, at least a portion of the first member annular coupling surface (6, 6*a*) and the at least one seal 22 are in annularly continuous contact, and at least a portion of the second member annular coupling surface (8, 8*a*) and at least one seal 22 are in annularly continuous contact. In these embodiments, the quantity of three-dimensional space of the cavity 24 is defined by the three-dimensional empty space within the volume enclosed by a boundary formed of the first member bottom surface (6, 6*a*), the second member bottom surface (8, 8*a*), and the seal 22, within the diameter of the seal 22. In some of these embodiments, the width and radius of the first member annular coupling surface (6, 6*a*) and the second member annular coupling surface (8, 8*a*) are equal.

When assembled, the sealingly interfaced first member 2 and the second member 4 cooperate with the seal 22, the cooperation being sufficient to prevent a pressure increase within the cavity 24 when the coupler is subjected to a pre-determined ambient pressure, the pre-determined ambient pressure being greater than the pressure within the cavity 24 at assembly. The force required to separate (after assembled) the first member 2 from the second member 4 at a pre-determined water depth, is the ambient pressure at the pre-determined depth times the area of the plane formed by the seal 22.

Some embodiments include at least one first polarized magnet 34*a* associated with the first member 2 and at least one second polarized magnet 34*b* associated with the second member 4, wherein the first polarized magnet 34*a* and the second polarized magnet 34*b* are oppositely polarized. In these embodiments, at least one first polarized magnet 34*a* and at least one second polarized magnet 34*b* are located in association with the first member 2 and the second member 4, respectively, such that the magnetic force between the at least one first polarized magnet 34*a* and the at least one second polarized magnet 34*b* is sufficient to maintain the interfacing in conditions wherein the coupler is not subjected to tensile force or external pressure greater than internal pressure.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

The invention claimed is:

1. A coupler, comprising:

a first member having a first member bottom surface and a first member upper surface, said first member bottom surface including a first member coupling surface;

a float attachment associated with said first member upper surface;

a second member having a second member bottom surface and a second member upper surface, said second member bottom surface including a second member coupling surface;

a weight attachment associated with said second member upper surface;

at least one seal associated with one of said first member coupling surface and said second member coupling surface;

wherein, when assembled, said first member coupling surface and said second member coupling surface both sealingly interface with said at least one seal; and a cavity within the interfaced first member, second member, and seal; said cavity bounded at least in part by at least a portion of said first member bottom surface, said second member bottom surface, and said seal when said first member and said second member are sealingly interfaced with said at least one seal.

2. The coupler of claim 1, wherein when assembled, said interfaced first member aid said second member cooperate with said seal, said cooperation being sufficient to prevent a pressure increase within said cavity when said coupler is subjected to a pre-determined ambient pressure, said pre-determined ambient pressure being greater than the pressure within said cavity at assembly.

3. The coupler of claim 1, wherein said first coupling surface and said second coupling surface are annular.

4. The coupler of claim 3, wherein the width and radius of said first coupling surface and the width and radius of said second coupling surface are dimensioned such that, when assembled, at least a portion of said first coupling surface and said at least one seal are in annularly continuous contact, and at least a portion of said second coupling surface and said at least one seal are in annularly continuous contact.

5. The coupler of claim 3, wherein the width and radius of said first coupling surface and said second coupling surface are equal.

6. The coupler of claim 1, further comprising at least one first polarized magnet associated with said first member; and at least one second polarized magnet associated with said second member, wherein said first polarized magnet said second polarized magnet are oppositely polarized.

7. The coupler of claim 6, wherein said at least one first polarized magnet and said at least one second polarized magnet are located in association with said first member and said second member, respectively, such that the magnetic force between said at least one first polarized magnet and said at least one second polarized magnet is sufficient to maintain said interfacing in conditions wherein said coupler is not subjected to tensile force or external pressure greater than internal pressure.

8. The coupler of claim 7, wherein said seal is ring shaped.

9. The coupler of claim 8, wherein said first member coupling surface being annular and having a first member predetermined inner diameter and a first member predetermined outer diameter; said second member coupling surface being annular and having a second member predetermined inner diameter and a second member predetermined outer diameter; said first member bottom surface comprises a first member depressed section within said first member inner radius, said depressed section being depressed relative to said first member coupling surface; said second member bottom surface comprises a second member depressed section within said second member inner radius, said depressed section being depressed relative to said second member coupling surface; wherein the quantity of three-dimensional space of said cavity is defined by the three-dimensional empty space within the volume enclosed by a boundary formed of said first member bottom surface, said second member bottom surface, and said seal, within the diameter of said seal.

10. The coupler of claim 9, wherein the force required to separate said first member from said second member at a pre-determined water depth after assembled is the ambient pressure at said pre-determined depth times the area within said seal.

* * * * *